US007645038B2

(12) United States Patent
Kim

(10) Patent No.: US 7,645,038 B2
(45) Date of Patent: Jan. 12, 2010

(54) SPITTING DEVICE FOR INKJET HEAD OF IMAGE FORMING APPARATUS

(75) Inventor: Soo-hyun Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 437 days.

(21) Appl. No.: 11/505,434

(22) Filed: Aug. 17, 2006

(65) Prior Publication Data

US 2007/0046757 A1 Mar. 1, 2007

(30) Foreign Application Priority Data

Aug. 29, 2005 (KR) ..... 10-2005-0079449

(51) Int. Cl.
*B41J 2/01* (2006.01)

(52) U.S. Cl. ..... 347/107; 347/104

(58) Field of Classification Search ..... 347/22, 347/30, 31, 36, 104, 107
See application file for complete search history.

(56) References Cited

U.S. PATENT DOCUMENTS

2005/0062794 A1* 3/2005 Kanamitsu et al. ..... 347/31
2005/0093919 A1* 5/2005 Takatsuka et al. ..... 347/30

FOREIGN PATENT DOCUMENTS

| | | |
|---|---|---|
| JP | 4-44876 | 2/1992 |
| JP | 2000-351205 | 12/2000 |
| JP | 2002-192777 | 7/2002 |
| KR | 90-11592 | 8/1990 |

* cited by examiner

*Primary Examiner*—Matthew Luu
*Assistant Examiner*—Kendrick X Liu
(74) *Attorney, Agent, or Firm*—Stanzione & Kim LLP

(57) ABSTRACT

A spitting device for an inkjet head includes an array type inkjet head on which nozzle units are formed, and a platen which is disposed opposite to the nozzle units of the inkjet head. The platen includes ink outlets and printing medium guide ribs formed thereon, and supports a back surface of a printing medium. The platen includes a first platen unit and a second platen unit which is movably connected to the first platen unit and on which second printing medium guide ribs are formed. The spitting device can prevent the printing medium guide ribs from being contaminated by ink ejected from the nozzle units and allows the printing medium to be more stably fed during high-speed printing.

11 Claims, 5 Drawing Sheets

SPITTING DEVICE FOR INKJET HEAD OF IMAGE FORMING APPARATUS

CROSS-REFERENCE TO RELATED APPLICATIONS

This application claims the priority of Korean Patent Application No. 10-2005-0079449, filed on Aug. 29, 2005, in the Korean Intellectual Property Office, the disclosure of which is incorporated herein in its entirety by reference.

BACKGROUND OF THE INVENTION

1. Field of the Invention

The present general inventive conceptrelates to a spitting device for an inkjet head of an image forming apparatus, and more particularly, to a spitting device for an inkjet head which can prevent printing medium guide ribs formed on a platen from being contaminated by ink ejected from nozzle units during a spitting operation and allows a printing medium to be more stably fed during high-speed printing.

2. Description of the Related Art

An inkjet image forming apparatus can be used as a printer or as a multifunctional device including functions of a copier, a fax machine, and a scanner. When the inkjet image forming apparatus used as a printer, because printing is achieved in a non-impact manner, less printing noise is produced than in a case of a dot printer. Moreover, the inkjet image forming apparatus has advantages in that it can be made compact and light and can perform color printing using a multiple color ink cartridge. An inkjet head ejects fine ink droplets onto a desired position on a printing medium. The inkjet head has a cartridge form, is connected to an ink container, and installed in the inkjet image forming apparatus. The inkjet head uses heat energy or a piezoelectric element as a driving source for ejecting the ink. The inkjet head is fabricated to have high resolution by semiconductor manufacturing methods, such as etching, depositing, and sputtering.

Nozzle units formed on the inkjet head spray ink onto the printing medium. After printing, remaining ink and other substances are attached to a surface of the nozzle units of the inkjet head and harden in holes of the nozzle units over time. Consequently, a defective nozzle, which cannot eject ink droplets during printing, may occur, or an ejecting direction of the ink droplets may be altered, and thus the ink droplets are ejected onto an unintended position of the printing medium. Thus, to keep the surface of the nozzle unit of the inkjet image forming apparatus clean, the inkjet image forming apparatus includes a wiping element that wipes off ink remaining on the surface of the nozzle unit. In addition, to prevent nozzles from clogging, the inkjet image forming apparatus includes a spitting element that removes deposits in the holes of the nozzle units by ejecting ink, and a capping element that prevents ink from drying by covering the nozzle units during a standby state and protects the nozzle units from external particles.

The above wiping element, spitting element, and capping element are commonly referred to as a maintenance element. To miniaturize the inkjet image forming apparatus, a maintenance element of a small size and a simple structure is required.

An array type inkjet head, which includes nozzle units having a length corresponding to a width of printing medium and conveys the printing medium in a lengthwise direction of the printing medium, has a relatively long width. Therefore, a space where the maintenance element is installed is relatively large. During a maintenance operation, the inkjet head does not have to move to a maintenance region, because the wiping element, the spitting element, and the capping element alternately move to the nozzle unit fixed to a predetermined location and perform a predetermined maintenance operation.

The spitting element includes the nozzle units formed on the inkjet head, an ink outlet formed on a platen, and a waste ink container that stores ink which was ejected during a spitting operation and flows thereinto through the ink outlet of the platen.

On the platen, typically, a plurality of conventional printing medium guide ribs are formed to support a back surface of the printing medium. Some of ink ejected from the nozzle unit of the inkjet head during the spitting operation may not flow into the ink outlet but be dispersed around the ink outlet, thereby contaminating the conventional printing medium guide ribs. Moreover, after the spitting operation, the conventional printing medium guide ribs contaminated by the ink may contaminate the back surface of the printed printing medium.

Also, since, the conventional printing medium guide ribs are not installed on a portion where the ink outlet is formed and thus an area of the printing medium guide ribs that support the back surface of the printing medium is reduced, the printing medium is not reliably fed during high-speed printing.

SUMMARY OF THE INVENTION

The present general inventive concept provides a spitting device for an inkjet head of an image forming apparatus, the spitting device having a platen divided into a fixed portion on which ink outlets are formed and a moving portion on which printing medium guide ribs are formed, wherein the moving portion is moved from an ejecting region during a spitting operation, thereby preventing the printing medium guide ribs from being contaminated by ink.

The present general inventive concept also provides a spitting device for an inkjet head, the spitting device allows a printing medium to be more reliably fed during high-speed printing.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a spitting device for an inkjet head, including an array type inkjet head having nozzle units formed therein and a platen, which is disposed to face the nozzle units of the inkjet head, having ink outlets and printing medium guide ribs formed thereon to support a back surface of a printing medium, wherein the platen includes a first platen unit and a second platen unit which is movably connected to the first platen unit and on which second printing medium guide ribs are formed.

The ink outlets may be formed at positions in the first platen unit which correspond to the respective nozzle units.

First printing medium guide ribs may be formed on the first platen unit.

A surface of the first platen unit facing the nozzle units may have a step difference having a higher surface and a lower surface, and the first printing medium guide ribs may be formed to have the higher surface and the ink outlets may be formed on the lower surface of the first platen unit.

The second printing medium guide ribs of the second platen unit may cross over and partly cover the ink outlets on the first platen unit in a longitudinal direction of the printing medium and move to a predetermined position to completely expose the ink outlets during a spitting operation.

A height of a top surface of the first printing medium guide ribs may be the same as a height of a top surface of the second printing medium guide ribs with respect to a bottom surface of the first platen unit.

The first platen unit may include a second platen unit guide to protrude therefrom, the second platen unit may include a second platen groove portion to receive the second platen unit guide while sliding with respect to the first platen unit and a second platen gear portion formed on the second platen unit, and the second gear portion may be driven by a driving force from a driving motor via a predetermined gear.

The spitting device may further comprise a waste ink container disposed below the platen unit to collect ink which is ejected from the nozzle units through the ink outlets.

The nozzle units may be formed on a surface of the inkjet head in a zig-zag pattern and the ink outlets are formed on the platen in the zig-zag pattern.

The foregoing and/or other aspects and utilities of the present general inventive concept may also be achieved by providing an image forming apparatus having an inkjet printhead having a plurality of nozzles to form an image on a printing medium and to perform a spitting operation to clean the nozzles, a platen to support the printing medium, a first platen unit having a plurality of ink outlets to correspond to the plurality of nozzles, and having first ribs provided thereon, and a second platen unit to move between a first position and a second position with respect to the platen unit, and having second ribs formed thereon to be disposed over portions of the plurality of ink outlets in the first position of the second platen unit.

The foregoing and/or other aspects and utilities of the present general inventive concept may also be achieved by providing an image forming apparatus having an inkjet printhead, including nozzles to eject ink on a printing medium, a stationary platen having first ribs provided thereon to support the printing medium during a printing operation, and ink outlets formed therein for the nozzles to eject ink therethrough, and a movable platen having second ribs provided thereon to cover a portion of the ink outlets and support the printing medium during a printing operation, and to not cover the ink outlets during a cleaning operation.

The foregoing and/or other aspects and utilities of the present general inventive concept may also be achieved by providing an image forming apparatus, including an inkjet printhead having one or more nozzle units, a first platen unit having one or more ink outlets to correspond to the respective one or more nozzle units, and a second platen unit having ribs to face the one or more nozzle units, and movable with respect to the first platen unit to selectively cover a portion of the one or more ink outlets.

The foregoing and/or other aspects and utilities of the present general inventive concept may also be achieved by providing an image forming apparatus, including an inkjet printhead having one or more nozzle units, a first platen unit having first ribs, a second platen unit having second ribs, and one or more ink outlets formed on one of the first platen unit and the second platen unit.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
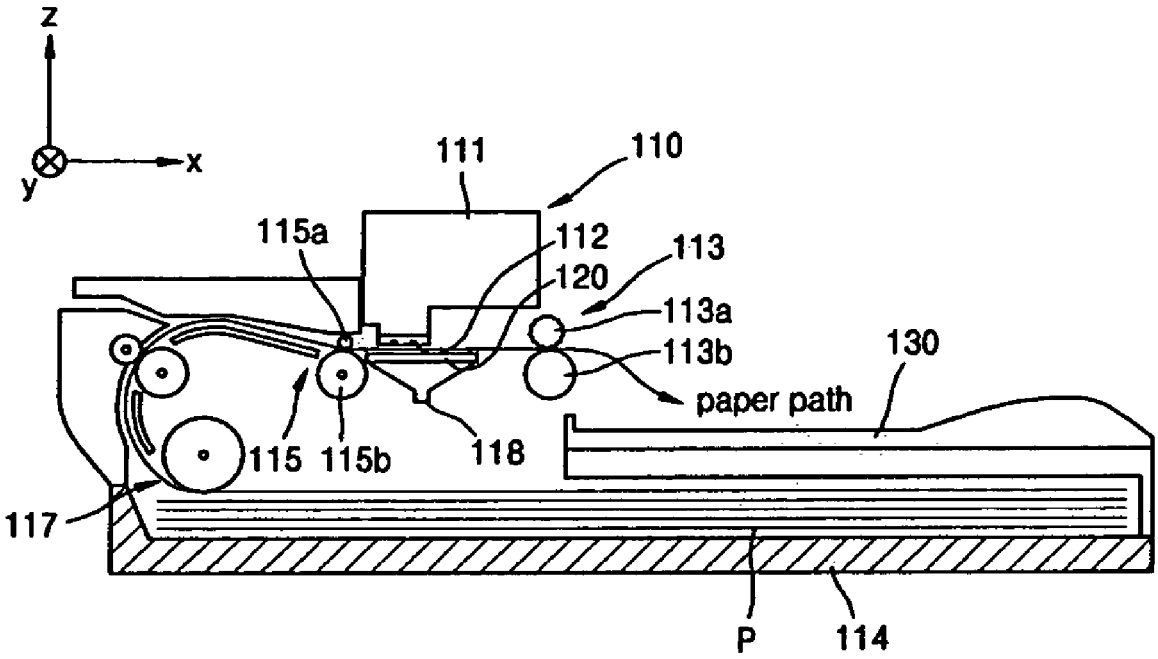
FIG. 1 is a cross-sectional side view illustrating an inkjet image forming apparatus including a spitting device according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a cross-sectional side view illustrating an inkjet image forming apparatus including a spitting device according to an embodiment of the present general inventive concept. Referring to FIG. 1, the inkjet image forming apparatus includes an array type inkjet head 110, a feeding cassette 114 to contain a printing medium P, a pickup roller 117 to pick up the printing medium P, feeding rollers 115*a* and 115*b* to feed the picked up printing medium P to a plurality of nozzle units 112, discharging rollers 113 to discharge the printing medium P on which an image has been printed, and a discharge tray 130 in which the discharged printing medium P is stacked.

The printing medium P is fed in a feeding direction X. The plurality of nozzle units 112 may be arranged in a direction that is a parallel to a widthwise direction Y of the printing medium P. The inkjet head 110 includes a body 111 to store ink and the plurality of nozzle units 112 to eject the ink to form the image on the printing medium P.

The discharging rollers 113 includes a star wheel 113*a* installed in the widthwise direction Y of the printing medium P and a support roller 113*b* which is opposite to the star wheel 113*a* and supports a back surface of the printing medium P. The star wheel 113*a* point-contacts a top surface of the printing medium P, thereby preventing contamination of the image which has been formed on the top surface of the printing medium P using the ejected ink and is not yet dried during high-speed printing. If the printing medium P is stacked on a previously stacked printing medium P in the discharge tray 130 before the ink on a top surface of the previous printing medium P is dried, the back surface of the following printing medium P may be contaminated by the ink on the previous printing medium P. To prevent the contamination of the back side of the printing medium P, the inkjet image forming apparatus may further include a drying device (not shown).

For maintenance of the nozzle units 112, the nozzle units 112 are capped to prevent the ink stored in the inkjet head 110 from drying, ink remaining on a surface of the nozzle unit 112 is wiped off, and a spitting operation is performed to prevent the nozzle unit 112 from clogging.

Figure 2:
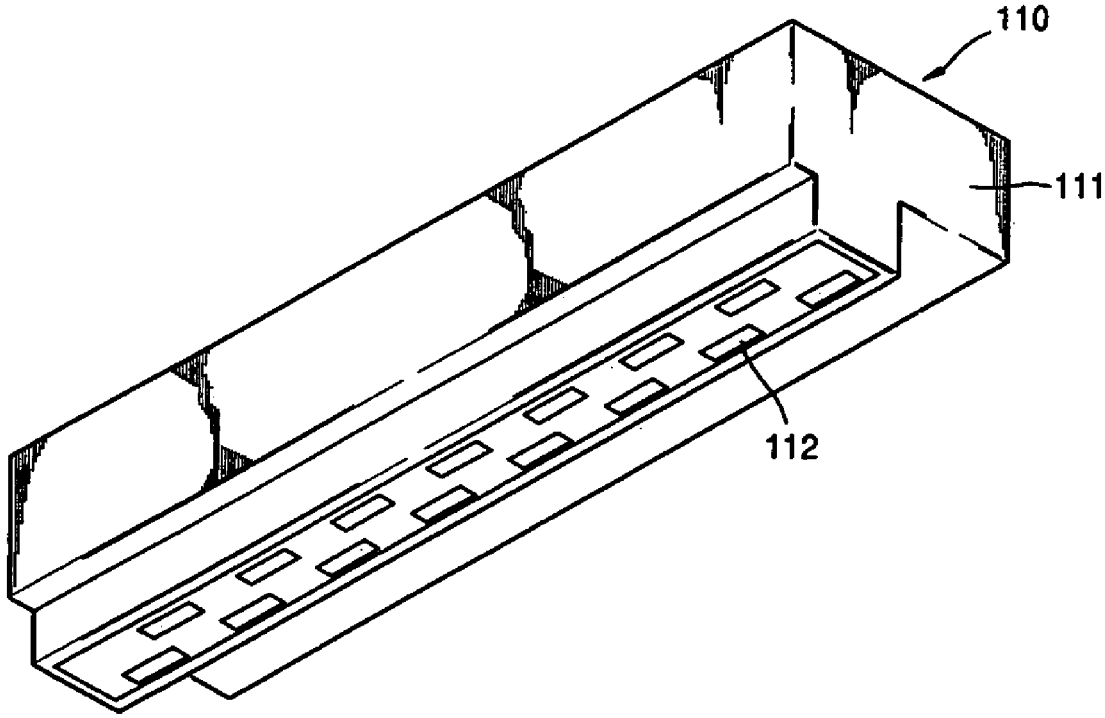
FIG. 2 is a perspective view illustrating an inkjet head included in the spitting device of FIG. 1.

FIG. 2 is a perspective view illustrating the inkjet head 110 included in the spitting device of FIG. 1. Referring to FIG. 2, the inkjet head 110 includes a body 111 and the nozzle units 112. A length of the inkjet head 110 on which the nozzle units 112 are formed corresponds to the width of the printing medium P. In the present embodiment of the present general inventive concept, the nozzle units 112 are arranged in a zig-zag pattern. However, the arrangement of the nozzle units 112 is not limited to the above, and the nozzle units 112 may be arranged in a variety of patterns, such as a linear pattern in the width direction. The nozzle units 112 are arranged such that ends of adjacent nozzle units overlap each other to prevent a printing gap from being formed on the printing medium P.

Figure 3:
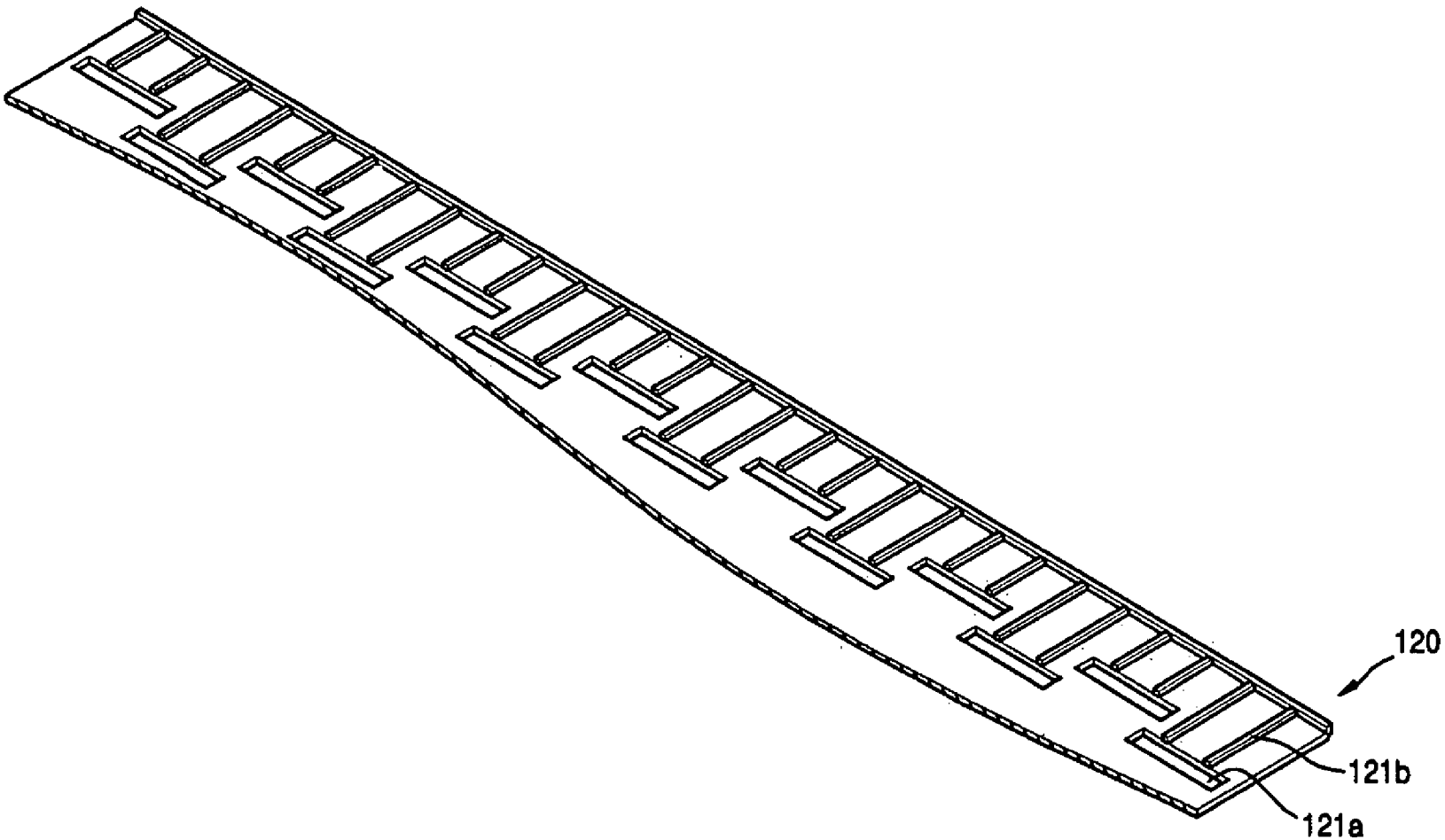
FIG. 3 is a view schematically illustrating an arrangement of ink outlets formed on a platen included in the spitting device of FIG. 1.

FIG. 3 is a view schematically illustrating an arrangement of ink outlets 121*a* formed on a platen 120 included in the spitting device of FIG. 1. Referring to FIG. 3, the ink outlets 121*a* are formed on the platen 120 at positions corresponding to the nozzle units 112 included in the inkjet head 110, and the number of the ink outlets 121*a* may be the same as a number of the nozzle units 112. Thus, ink ejected from the nozzle units 112 during the spitting operation is collected in a waste ink container 118 (illustrated in FIGS. 1, 4, and 5), which will be described later, through the corresponding ink outlets 121*a* of the platen 120. For example, when the nozzle units 112 are arranged in two parallel lines, the ink outlets 121 are arranged in the two lines, and when nozzle units 112 are arranged in a zig-zag formation, the ink outlets 121 are arranged in the same zig-zag formation.

Figure 4:
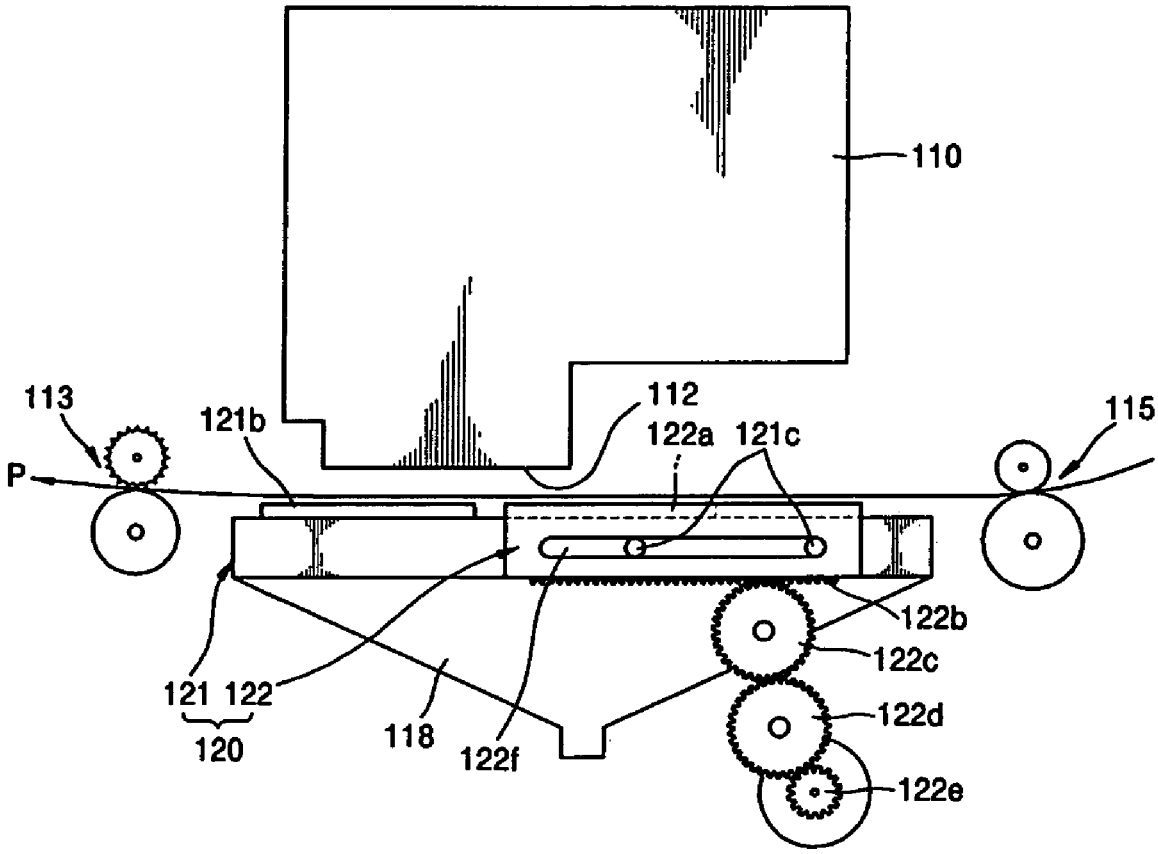
FIG. 4 is an expanded side view illustrating the spitting device of FIG. 1.
Figure 5:
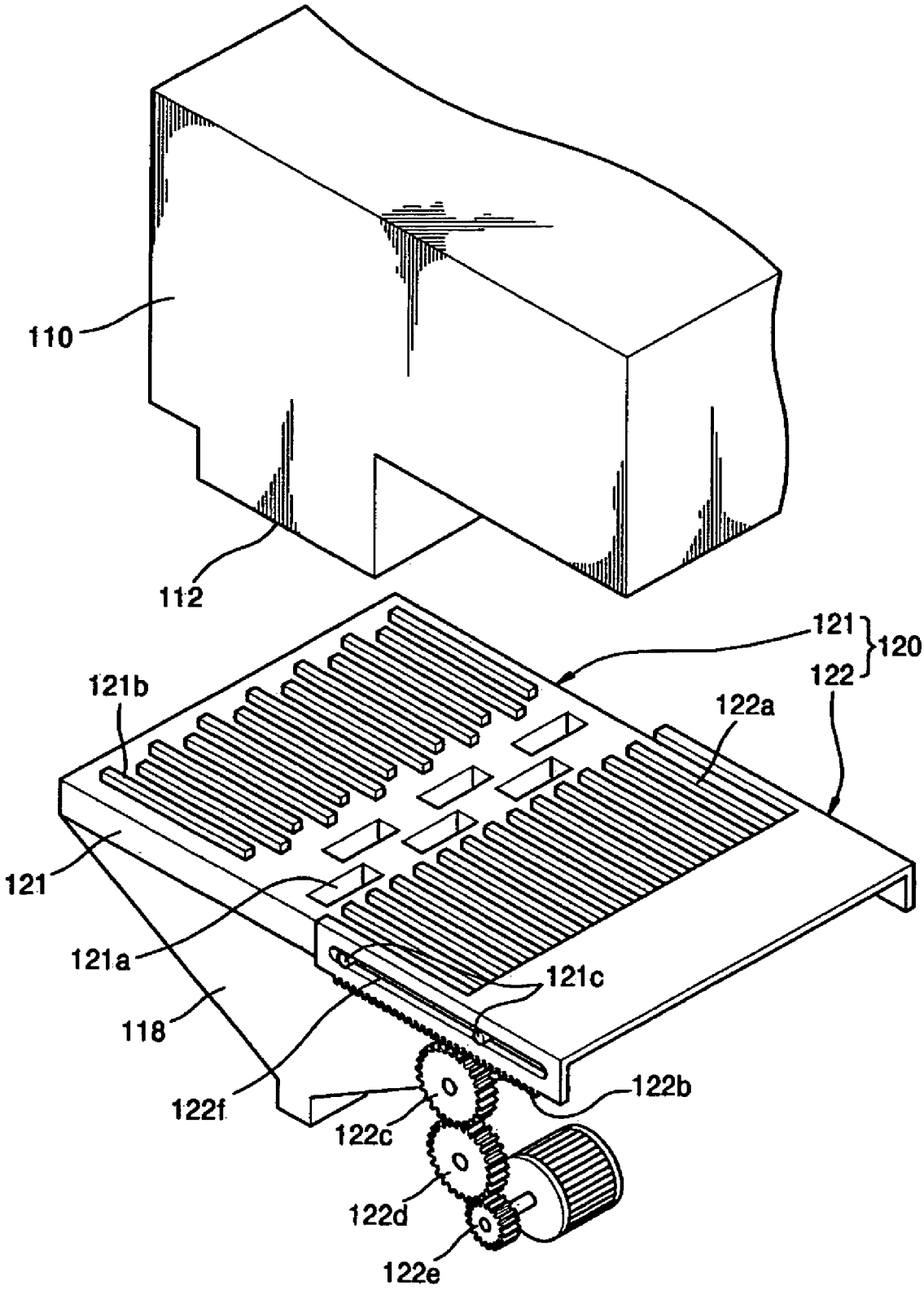
FIG. 5 is an exploded perspective view illustrating the spitting device of FIG. 1.

FIG. 4 is an expanded side view illustrating the spitting device of FIG. 1 and FIG. 5 is an exploded perspective view illustrating the expanded spitting device of FIG. 1. Referring to FIGS. 4 and 5, the spitting device includes the inkjet head 110, the platen 120, and the waste ink container 118.

The nozzle units 112 are formed on a bottom surface of the inkjet head 110. The platen 120 includes a first platen unit 121 and a second platen unit 122 movably connected to the first platen unit 121.

A surface of the first platen unit 121 facing the nozzle units 112 may have a step difference where first printing medium guide ribs 121*b* are formed on a higher surface of the first platen unit 121 and the ink outlets 121*a* are formed on a lower surface of the first platen unit 121. However, the present invention is not limited to the above, and the surface of the first platen unit 121 facing the nozzle units 112 may be formed as an even surface without the step difference. In a case without the step difference, the printing medium guide ribs 121*b* may not be formed on the first platen unit 121. It is possible that the first printing medium guide ribs 121*b* protrude from a surface where the ink outlets 121*a* are formed.

The second platen unit 122 is movably connected to a lower surface of the stepped surface of the first platen unit 121. The connection between the second platen unit 122 and the first platen unit 121 will be described below.

Second platen unit guides 121*c* protrude from both sides of the first platen unit 121 which are perpendicular to a feeding direction of the printing medium P, and second platen groove portions 122*f* are formed on both sides of the second platen unit 122. A second platen gear portion 122*b* is also formed on the second platen unit 122 to receive the corresponding second platen unit guides 121*c* so that the second platen unit guides 121*c* slide therein. The second platen gear portion 122*b* is driven by a driving force from a driving motor 122*e* via a predetermined pair of gears, and converts a rotation movement into a linear movement. In the present embodiment of the present general inventive concept, the driving motor 122*e* provides a driving force to the second platen gear unit 122*b* via a first gear 122*c* and a second gear 122*d*. However, more and different kinds of gears to connect the driving motor 122*e* and the second platen gear portion 122*b* may be used. Furthermore, as long as the same effects can be obtained, the structure of the platen including the first and second platen units may be variously modified.

In the above structure, second printing medium guide ribs 122*a* on the second platen unit 122 intersect and partly cover the ink outlets 121*a* on the first platen unit 121 during a printing operation except during the spitting operation, and are moved to a predetermined position during a spitting operation such that the ink outlets 121*a* are completely exposed. In the present embodiment of the general inventive concept, the second platen unit 122 moves in a direction opposite to the feeding direction X of the printing medium P with respect to the first platen unit 121.

Second printing medium guide ribs 122*a* are formed on a surface of the second platen unit 122 facing the nozzle units 112. The second printing medium guide ribs 122*a* are disposed at positions extended from the first printing medium guide ribs 121*b* in a lengthwise direction X of the first printing medium guide ribs 121*b* of the first platen unit 121. Thus, both of the first printing medium guide ribs 121*b* and the second printing medium guide ribs 122*a* support the back surface of the printing medium P in a predetermined direction parallel to the feeding direction X of the printing medium P, thus an alignment of the printing medium P is improved while the printing medium P is conveyed. The first printing medium guide ribs 121*b* and the second printing medium guide ribs 122*a* may also be arranged in a zig-zag fashion in a predetermined direction parallel to the feeding direction of the printing medium P. The number of the first printing medium guide ribs 121*b* and the number of the second printing medium guide ribs 121*a* may be the same.

Since, during the printing operation, except during the spitting operation, the second printing medium guide ribs 122*a* intersect the ink outlets 121*a* to partly or entirely cover the ink outlets 121*a* in the feeding direction X, a problem of the conventional image forming apparatus wherein the printing medium is not stably fed during high-speed printing because the printing medium guide ribs are not located on an area where ink outlets are formed, and to reduce a total contacting area between the printing medium P and the printing medium guide ribs.

A height of top surfaces of the first printing medium guide ribs 121*b* may be the same as a height of top surfaces of the second printing medium guide ribs 122*a* with respect to a bottom surface of the first platen unit 121 where the ink outlets 121 are formed. When the heights of the top surfaces of the first and second printing medium guide ribs 121*b* and 122*a* are the same, the first and second printing medium guide ribs 121*b* and 122*a* can substantially and evenly support the back surface of the printing medium P, thereby smoothly guiding the printing medium P.

The waste ink container 118 is disposed beneath the first platen unit 121, and collects ink which is ejected from the nozzle units 112 and passing through the ink outlets 121*a*.

Even though in the present embodiment of the present general inventive concept, the platen 120 of the spitting device is divided into the first platen unit 121 and the second platen unit 122 and the second platen unit 122 is horizontally moved on the first platen unit 121 in the feeding direction X of the printing medium P or in a direction opposite to the feeding direction, the present general inventive concept is not limited thereto. That is, although not illustrated, the platen 120 of the spitting device may be formed to include a first platen unit 121 and a second platen unit 122 which can move both horizontally and vertically with respect to the platen 120. In another embodiment, the second platen unit 122 may move horizontally or vertically with respect to the first platen unit 121. Specifically, the platen 120 may be designated such that the second platen unit 122 is coupled to the first platen unit 121 to support the back surface of the printing medium P except during a spitting operation and, during a spitting operation, the second platen unit vertically moves to the lower part of the first platen unit and then printing medium guide ribs formed on the second platen unit vertically and/or horizontally move inside a printing medium rib covering unit installed at a predetermined location so that the printing medium guide ribs are prevented from being contaminated by ink ejected from nozzle units during a spitting operation. To this end, a structure to move the second platen unit may be different from the structure in the present embodiment of the present general inventive concept.

Figure 6A:
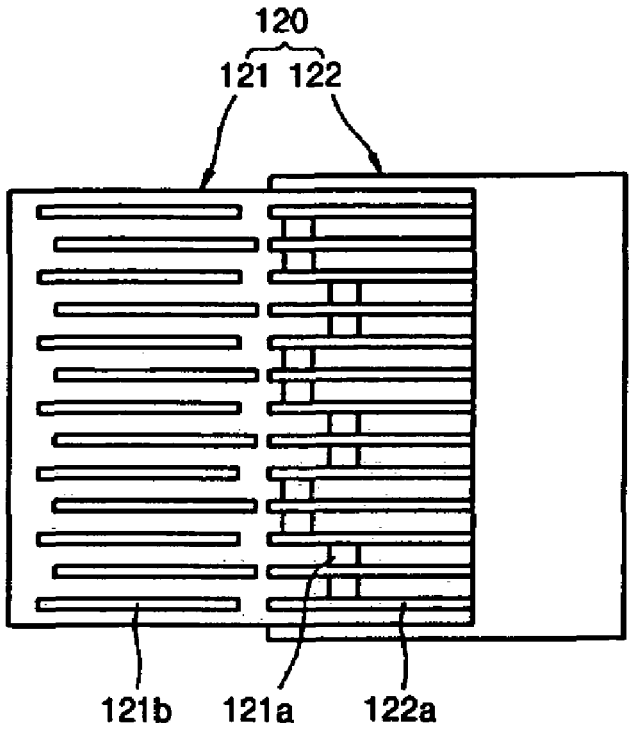
FIGS. 6A and 6B are plan views sequentially illustrating operations of the spitting device of FIG. 1.
Figure 6B:
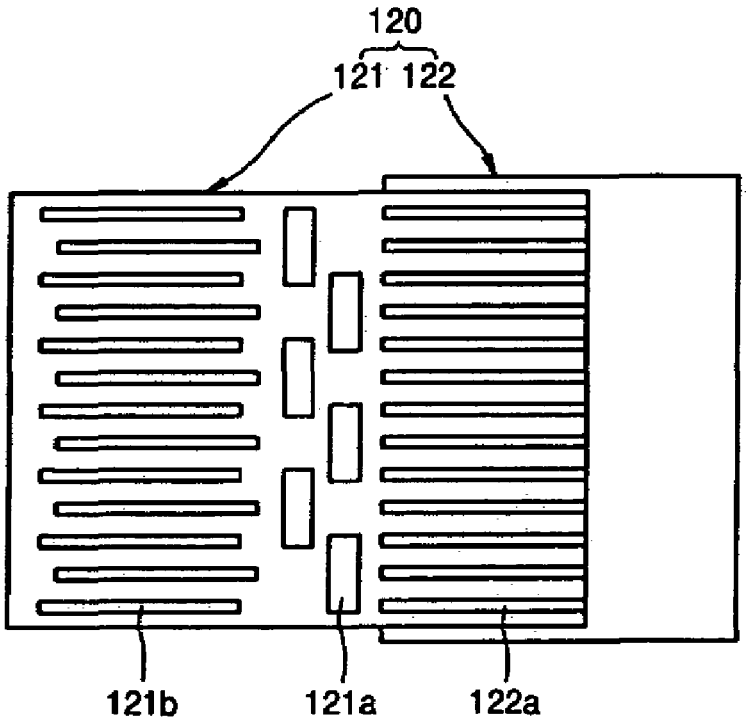

FIGS. 6A and 6B are plan views illustrating the spitting device of FIG. 1. Hereinafter, the operations of the spitting device will be described in detail with reference to FIGS. 5, 6A and 6B.

First, when spitting is not performed, that is, during printing or the like, referring to FIG. 6A, the second platen unit 122 is at an initial position. At this moment, the second printing medium guide ribs 122*a* cross over the ink outlets 121*a* to partly cover the ink outlets 121*a* while being close to the first printing medium guide ribs 121*b*.

Then, when spitting starts, as shown in FIG. 5, the driving motor 122*e* operates, the gears 122*b*, 122*c*, and 122*d* are driven, and, thereby, the second platen unit 122 slides over the first platen unit 121 to horizontally move in a direction reverse to the feeding direction of the printing medium P. In this case, referring to FIG. 6B, the second printing medium guide ribs 122*a* are separated from the first printing medium guide ribs 121*b* and the ink outlets are totally exposed.

Finally, ink is ejected from the nozzle units 112 formed on the inkjet head 110. The ejected ink passes through the ink outlets 121*a* on the first platen unit 121 and then flows into the waste ink container 118 disposed below the first platen unit 121.

According to the present general inventive concept, in a spitting device of an inkjet head, a platen divided into a fixed portion where ink outlets are formed and a moving portion where printing medium guide ribs are formed and the moving portion is moved out of an ejecting region of the nozzle units during a spitting operation. Therefore, the spitting device can prevent the printing medium guide ribs from being contaminated by ink.

Furthermore, according to the present general inventive concept, a spitting device can more stably feed a printing medium during high-speed printing.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

an inkjet printhead having a plurality of nozzles to form an image on a printing medium and to perform a spitting operation to clean the nozzles;

a platen to support the printing medium, comprising:

a first platen unit having a plurality of ink outlets to correspond to the plurality of nozzles, and having first ribs provided thereon; and a second platen unit to move between a first position and a second position with respect to the first platen unit, and having second ribs formed thereon to be disposed over portions of the plurality of ink outlets in the first position of the second platen unit.

2. The image forming apparatus of claim 1, wherein the second ribs of the second platen unit does not cover the portions of the ink outlets in the second position of the second platen unit.

3. The image forming apparatus of claim 1, further comprising:

a waste container provided under the platen to hold ink ejected from the nozzles through the ink outlets during the spitting operation, wherein the second platen unit moves to the second position so that the portions of the ink outlets are not covered by the second ribs.

4. The image forming apparatus of claim 1, wherein:

the first ribs comprise a first height with respect to a surface of the first platen facing the nozzles of the inkjet printhead, the second ribs comprise a second height with respect to the surface, and the first height is substantially the same as the second height.

5. The image forming apparatus of claim 1, wherein the first ribs are formed having in a direction parallel to a feeding direction of the printing medium.

6. The image forming apparatus of claim 1, wherein the second ribs are formed having in a direction parallel to a feeding direction of the printing medium.

7. The image forming apparatus of claim 1, wherein the first ribs are arranged in first lines, the second ribs are arranged in second lines, and the first and second lines are parallel to a feeding direction of the printing medium.

8. The image forming apparatus of claim 7, wherein the first lines are identical to the second lines.

9. The image forming apparatus of claim 7, wherein the first lines do not overlap the second lines.

10. The image forming apparatus of claim 1, wherein the number of first ribs is the same as the number of second ribs.

11. The image forming apparatus of claim 1, wherein:

the first ribs protrude from a surface of the first platen unit where the ink outlets are formed towards the inkjet printhead, by a height, and the second ribs protrude from a surface of the second platen unit towards the inkjet printhead by a second height.

* * * * *

UNITED STATES PATENT AND TRADEMARK OFFICE

CERTIFICATE OF CORRECTION

PATENT NO. : 7,645,038 B2
APPLICATION NO. : 11/505434
DATED : January 12, 2010
INVENTOR(S) : Soo-hyun Kim It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 541 days.

Signed and Sealed this

Twenty-first Day of December, 2010

David J. Kappos

David J. Kappos
*Director of the United States Patent and Trademark Office*